US006884130B2

(12) United States Patent
Okabe

(10) Patent No.: US 6,884,130 B2
(45) Date of Patent: Apr. 26, 2005

(54) CONTROL SYSTEM FOR OUTBOARD MOTOR

(75) Inventor: Yoshihiko Okabe, Hamamatsu (JP)

(73) Assignee: Yamaha Marine Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 10/717,319

(22) Filed: Nov. 19, 2003

(65) Prior Publication Data

US 2004/0106337 A1 Jun. 3, 2004

(30) Foreign Application Priority Data

Nov. 29, 2002 (JP) ..... 2002-346888

(51) Int. Cl.[7] ..... B63H 20/08
(52) U.S. Cl. ..... 440/61 H; 440/84; 440/1
(58) Field of Search ..... 440/1, 84–86

(56) References Cited

U.S. PATENT DOCUMENTS

| | | | | |
|---|---|---|---|---|
| 4,191,866 | A | 3/1980 | Nakajima et al. | 200/4 |
| 4,549,869 | A | 10/1985 | Iida et al. | 440/84 |
| 4,759,731 | A | 7/1988 | Uchida et al. | 440/1 |
| 4,767,363 | A | 8/1988 | Uchida et al. | 440/1 |
| 4,824,407 | A | 4/1989 | Torigai et al. | 440/1 |
| 4,931,025 | A | 6/1990 | Torigai et al. | 440/1 |
| 5,051,102 | A | 9/1991 | Onoue | 440/75 |
| 5,171,171 | A | 12/1992 | Tani | 440/1 |
| 5,230,643 | A | 7/1993 | Kanno | 440/86 |
| 5,352,137 | A | 10/1994 | Iwai et al. | 440/1 |
| 5,352,138 | A * | 10/1994 | Kanno | 440/1 |
| 5,366,393 | A | 11/1994 | Uenage et al. | 440/1 |
| 5,575,698 | A | 11/1996 | Ogino | 440/75 |
| 5,910,191 | A | 6/1999 | Okamoto | 74/473.14 |
| 6,015,319 | A | 1/2000 | Tanaka | 440/84 |
| 6,352,045 | B1 | 3/2002 | Takashima | 114/55.5 |
| 6,682,371 | B2 * | 1/2004 | Steinhauser | 440/1 |

FOREIGN PATENT DOCUMENTS

| | | |
|---|---|---|
| JP | 2817738 | 8/1998 |
| JP | 11-34986 | 2/1999 |
| JP | 2890471 | 2/1999 |
| JP | 11-208589 | 8/1999 |

* cited by examiner

*Primary Examiner*—Jesus D. Sotelo
(74) *Attorney, Agent, or Firm*—Knobbe, Martens, Olson & Bear, LLP

(57) ABSTRACT

An outboard motor has a drive unit and a bracket assembly that supports the drive unit. The drive unit moves right and left. The drive unit has an engine that incorporates throttle valves and a transmission. A propeller is powered by the engine. The throttle valves move between closed and open positions. The transmission moves among shift positions to set the propeller to either forward, reverse or neutral mode. A steering actuator moves the drive unit right and left. A throttle valve actuator moves the throttle valves between the closed and open positions. A shift actuator moves the transmission among the shift positions. A stick generates a steering control command, a throttle valve position control command and a shift control command. The stick can swing right and left and back and forth. The control commands are selectively generated in response to the swing movement of the stick. A control device controls the actuators based upon the commands.

31 Claims, 4 Drawing Sheets

CONTROL SYSTEM FOR OUTBOARD MOTOR

PRIORITY INFORMATION

The present application is based on and claims priority under 35 U.S.C. § 119 to Japanese Patent Application No. 2002-346888, filed on Nov. 29, 2002, the entire contents of which is expressly incorporated by reference herein.

BACKGROUND OF THE INVENTION

1. Field of the Invention

The present invention generally relates to a control system for an outboard motor, and more particularly relates to a control system that controls a steering position, an output power and a shift mode of an outboard motor.

2. Description of Related Art

Watercrafts can carry one or more outboard motors at a stern thereof. The outboard motors typically have a drive unit and a bracket assembly. The bracket assembly supports the drive unit on an associated watercraft for pivotal movement about a steering axis that extends vertically and also for pivotal movement about a tilt axis that extends horizontally.

The drive unit incorporates a propulsion device that propels the watercraft. The propulsion device typically is a propeller. A transmission is incorporated to couple the propulsion device with a prime mover that powers the propulsion device. Typically, the prime mover is an engine. The engine has a throttle valve that regulates an amount of air that is delivered to a combustion chamber of the engine. Normally, output power of the engine varies depending on the amount of the air.

A shift mechanism also is incorporated in the drive unit to move the transmission among forward, reverse and neutral positions that correspond to forward, reverse and neutral modes of the propulsion device, respectively. The propulsion device can propel the watercraft forwardly when the transmission is set in the forward position, while the propulsion device can propel the watercraft backwardly when the transmission is set in the reverse position. The propulsion device does not propel the watercraft when the transmission is set in the neutral position because the propulsion device is disconnected from the prime mover in this position.

A steering wheel is pivotally disposed in a cockpit of the watercraft. A remote controller also is placed in the cockpit of the watercraft. On the other hand, the drive unit employs a control device such as, for example, an electronic control device (ECU). Typically, the steering wheel and the remote controller are electrically connected to the ECU. As thus arranged, the movement of the steering wheel provides a steering position command to the ECU. Also, the movement of the remote controller provides a throttle valve position command and a shift position command to the ECU. The ECU thus controls a steering position of the drive unit, a throttle valve position and the shift position of the transmission based upon the steering position command, throttle valve position command and the shift position command, respectively.

Watercrafts that have the cockpit can enjoy such a control system described above. Relatively small watercrafts, however, do not have such a cockpit and the foregoing control system is not available for those small watercrafts.

Instead, a mechanical controller disposed on the outboard motor side is usable for all types of watercrafts. For example, JP 11-34986 discloses the mechanical controller. A throttle grip is pivotally disposed at one end of a controller housing and is connected to a throttle valve by a mechanical cable. A shift lever is reciprocally disposed at another portion of the controller housing and is connected to a transmission by a mechanical cable. The controller itself can move with a drive unit so as to place the drive unit at a certain steering position.

Due to such separate operating members (i.e., the throttle grip, the shift lever and the controller itself), handling of the controller is somewhat complicated and a human operator needs to be adjusted for handling those different operating members. In addition, because the controller is manually operated through the mechanical cables, a relatively large operating load and/or a moving stroke of each operating member are required. However, the controller does not have enough space to provide the operating members with the operating load and/or the moving stroke. The operator thus may want to have a controller that can more fit his or her desire than such a controller.

SUMMARY OF THE INVENTION

An aspect of the present invention involves the recognition of the need for an improved control system for an outboard motor that can provide a human operator of the outboard motor with a good operability that fits the operator's desire.

To address such a need, an aspect of the present invention involves an outboard motor that comprises a drive unit and a bracket assembly arranged to support the drive unit for pivotal movement about a steering axis. The drive unit moves between first and second steering positions. The drive unit comprises a prime mover. A propulsion device is powered by output of the prime mover. A regulating device is arranged to move between first and second regulating positions so as to regulate the output of the prime mover. A transmission is arranged to move between first and second shift positions so as to set the propulsion device to one of at least first or second mode. A first actuator is arranged to move the drive unit between the first and second steering positions. A second actuator is arranged to move the regulating device between the first and second regulating positions. A third actuator is arranged to move the transmission between the first and second shift positions. An operating device is configured to generate a first control command corresponding to a specific steering position between the first and second steering positions. A second control command corresponds to a specific regulating position between the first and second regulating positions. A third control command corresponds to either the first or second shift position. The operating device has multiple physical positions. The first, second and third control commands are selectively generated in response to the physical positions. A control device is configured to control the first, second and third actuators based upon the first, second and third commands, respectively.

In accordance with another aspect of the present invention, an outboard motor comprises a drive unit and a bracket assembly arranged to support the drive unit for pivotal movement about a steering axis. The drive unit moves between first and second steering positions. The drive unit comprises a prime mover. A propulsion device is powered by output of the prime mover. A regulating device is arranged to move between first and second regulating positions so as to regulate the output of the prime mover. A transmission is arranged to move between first and second shift positions so as to set the propulsion device to either first or second mode. A first actuator is arranged to move the drive unit between the first and second steering positions. A second actuator is arranged to move the regulating device between the first and second regulating positions. A third actuator is arranged to move the transmission between the first and second shift positions. An operating device is configured to generate a first control command corresponding to a specific steering position between the first and second steering positions. A second control command corresponds to a specific regulating position between the first and second regulating positions. A third control command corresponds to either the first or second shift position. The operating device moves right and left and back and forth. A right and left movement of the operating device generates the first command. A back and forth movement of the operating device generates the third command. An amount of the back and forth movement generates the second command. A control device is configured to control the first, second and third actuators based upon the first, second and third commands, respectively.

In accordance with a further aspect of the present invention, an outboard motor comprises a drive unit and a bracket assembly arranged to support the drive unit for pivotal movement about a tilt axis that extends generally horizontally. The drive unit comprises a prime mover. A propulsion device is powered by output of the prime mover. A regulating device is arranged to move between first and second regulating positions so as to regulate the output of the prime mover. An actuator is arranged to tilt the drive unit between first and second trim positions. A first sensor is configured to sense an actual regulating position of the regulating device. A second sensor is configured to sense an actual output of the prime mover. A third sensor is configured to sense an actual proceeding speed of the outboard motor. A control device controls the actuator based upon at least one of signals from the first, second and third sensors.

In accordance with a further aspect of the present invention, an outboard motor comprises a drive unit that has a prime mover and a propulsion device powered by output of the prime mover. A supporting device supports the drive unit on an associated watercraft for steering movement. Means are provided for changing the output of the prime mover. Means are provided for changing a propulsion mode of the propulsion device. Means are provided for steering the drive unit. Means are provided for generating control commands for the prime mover output changing means, the propulsion mode changing means and the steering means in response to physical positions of a single member. Means are provided for controlling the prime mover output changing means, the propulsion mode changing means and the steering means based upon the control commands.

A further aspect of the present invention is directed to a method for controlling an outboard motor that has a steerable drive unit and a single operating member. The drive unit has a prime mover and a propulsion device powered by the prime mover. The method comprises generating a first control command that provides a steering position of the drive unit at a first position of the operating member, generating a second control command that provides a magnitude of output of the prime mover at a second position of the operating member, generating a third control command that provides a propulsion mode of the propulsion device at a third position of the operating member, steering the drive unit based upon the first control command, controlling the output of the prime mover based upon the second control command, and setting the propulsion mode of the propulsion device based upon the third control command.

A further aspect of the present invention is directed to an outboard motor that comprises a drive unit. The drive unit has a prime mover and a propulsion device powered by output of the prime mover. A supporting device supports the drive unit on an associated watercraft for tilt movement. Means are provided for regulating the output of the prime mover. Means are provided for tilting the drive unit. Means are provided for sensing at least a regulating condition of the regulating means, the output of the prime mover, and a proceeding speed of the outboard motor. Means are provided for controlling the tilting means based upon a result of sensing by the sensing means.

A further aspect of the present invention is directed to a method for controlling an outboard motor that has a tiltable drive unit. The drive unit has a prime mover and a propulsion device powered by the prime mover. The method comprises regulating output of the prime mover, sensing a magnitude of the regulation, sensing the output of the prime mover, sensing a speed of the outboard motor, and tilting the drive unit based upon at least one of the sensed magnitude of the regulation, the sensed output of the prime mover and the sensed speed of the outboard motor.

BRIEF DESCRIPTION OF THE DRAWINGS

The foregoing and other features, aspects and advantages of the present invention are described in detail below with reference to the drawings of a preferred embodiment which is intended to illustrate and not to limit the invention. The drawings comprise four figures in which.

DETAILED DESCRIPTION OF THE PREFERRED EMBODIMENT OF THE INVENTION

Figure 1:
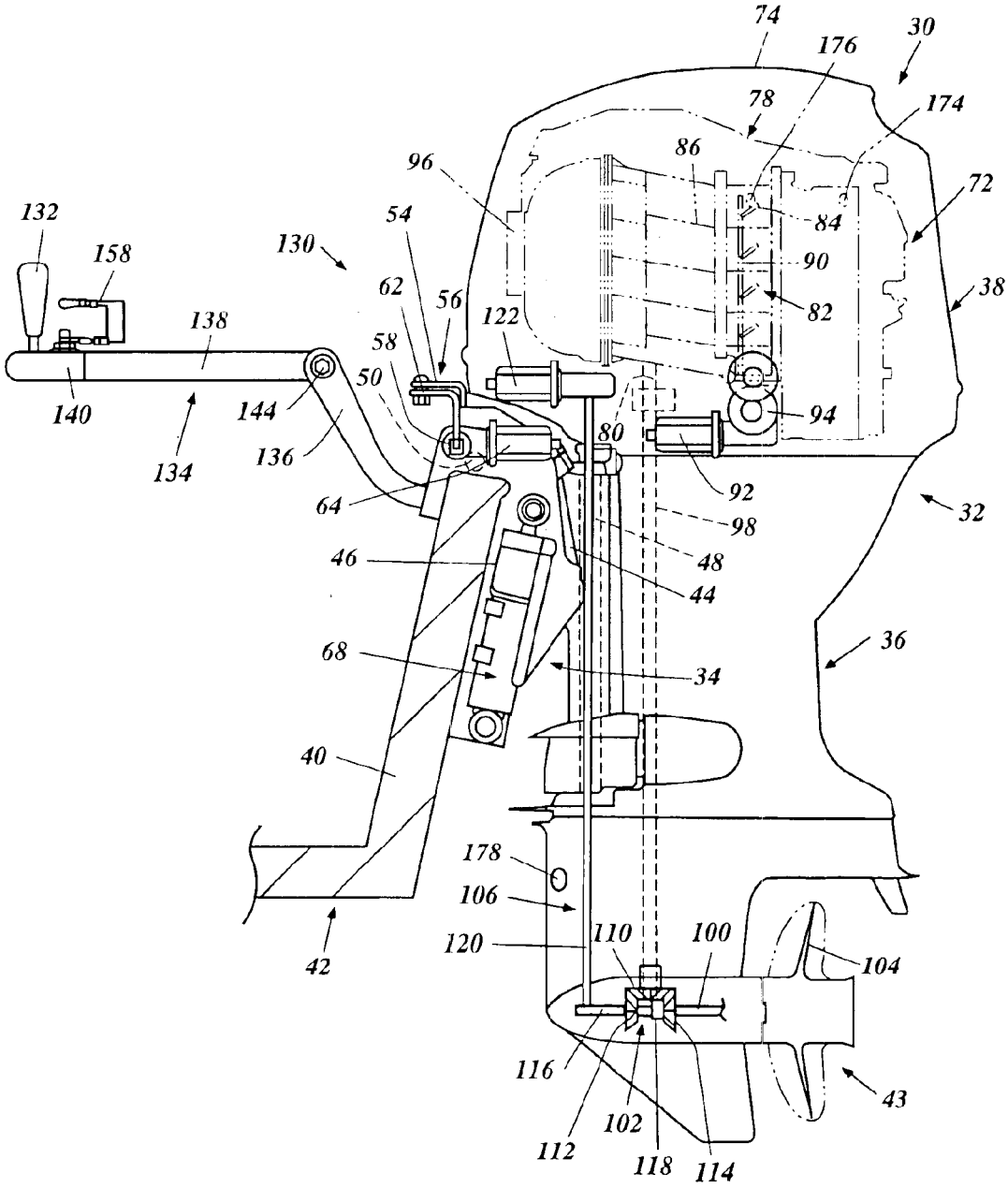
FIG. 1 illustrates a side elevational view of an outboard motor on the port side, the outboard motor configured in accordance with certain features, aspects and advantages of the present invention, a rear portion of an associated watercraft also shown, wherein a bracket assembly is depicted in section and some internal part of the outboard motor is schematically depicted by actual lines.
Figure 2:
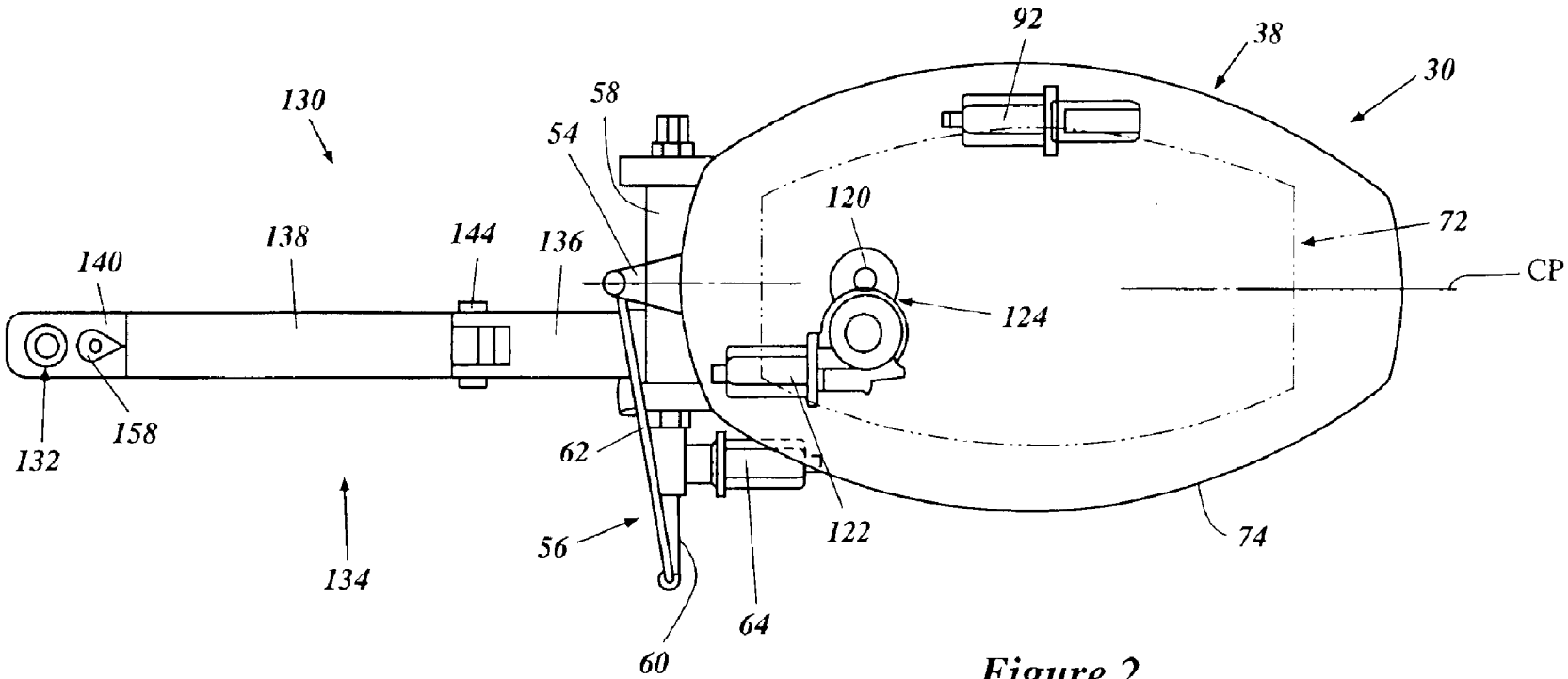
FIG. 2 illustrates a top plan view of the outboard motor of FIG. 1, wherein some internal part of the outboard motor is schematically depicted by actual lines also.

With reference to FIGS. 1 and 2, an overall construction of an outboard motor 30 configured in accordance with certain features, aspects and advantages of the present invention is described.

The outboard motor 30 preferably comprises a drive unit 32 and a bracket assembly or supporting device 34. The drive unit 32 preferably comprises a housing unit 36 and a power head 38 disposed atop the drive unit 32 and above the housing unit 36. The bracket assembly 34 supports the drive unit 32 on a transom 40 of an associated watercraft 42 and places a marine propulsion device 43 in a submerged position with the watercraft 42 resting on the surface of a body of water.

As used through this description, the terms "forward," "forwardly" and "front" mean at or to the side where the bracket assembly 34 is located, and the terms "rear,"

"reverse," "backwardly" and "rearwardly" mean at or to the opposite side of the front side, unless indicated otherwise or otherwise readily apparent from the context use.

The bracket assembly 34 preferably comprises a swivel bracket 44, a clamping bracket 46, a steering shaft 48 and a pivot pin 50. The steering shaft 48 preferably extends generally vertically through the swivel bracket 44 and is affixed to the housing unit 36 through upper and lower mount assemblies. The steering shaft 48 is pivotally journaled within the swivel bracket 44 for steering movement about a steering axis defined by the steering shaft 48. The steering axis extends vertically along a center plane CP that extends vertically and fore to aft relative to the outboard motor 30. Because the steering shaft 48 is affixed to the housing unit 36, the drive unit 32 pivots about the steering axis relative to the swivel bracket 44. Preferably, a steering lever 54 extends generally upward and forward from a top end of the steering shaft 48. A steering device 56 is provided to steer the drive unit 32 about the steering axis with the steering shaft 48.

The steering device 56 preferably comprises a hydraulically operated mechanism 58 that includes a hydraulic cylinder, a hydraulic piston reciprocating within the cylinder and a hydraulic pump powering the piston. A piston rod 60 extends outward beyond one end of the cylinder on the port side. An operating rod 62 connects a distal end of the piston rod 60 and the steering lever 54 to each other. The steering device 56 also comprises a steering actuator 64 affixed to a housing of the hydraulic mechanism 58 to actuate the hydraulic pump. The steering actuator 64 preferably is an electric motor that rotates in a right direction and a reversed direction. When activated, the steering actuator 64 actuates the operating rod 62 through the hydraulic pump. The operating rod 62 moves the steering lever 54 right and left between two fully steered positions about the steering axis so as to steer the drive unit 32, The clamping bracket 46 comprises a pair of bracket arms that are spaced apart from each other and are affixed to the watercraft transom 40. The pivot pin 50 extends generally horizontally and completes a hinge coupling between the swivel bracket 44 and the clamping bracket 46. The pivot pin 50 extends through the bracket arms such that the clamping bracket 46 supports the swivel bracket 44 for pivotal movement about a tilt axis defined by the pivot pin 50. The drive unit 32 together with the swivel bracket 44 thus can be tilted or trimmed about the pivot pin 50 relative to the clamping bracket 46.

As used in this description, the term "horizontally" means that the subject portions, members or components extend generally in parallel to the water surface when the watercraft 42 is substantially stationary with respect to the water surface and when the drive unit 32 is not tilted and is generally placed in the position shown in FIG. 1. The term "vertically" in turn means that portions, members or components extend generally normal to those that extend horizontally.

A tilt and trim adjustment device 68 preferably is provided between the swivel bracket 44 and the clamping bracket 46 to tilt (raise or lower) the swivel bracket 44 together with the drive unit 32 relative to the clamping bracket 46. The tilt and trim adjustment device 68 preferably comprises a hydraulically operated mechanism that includes a hydraulic cylinder, a hydraulic piston reciprocating within the cylinder and a hydraulic pump powering the piston. A piston rod extends outward beyond one end of the cylinder. Preferably, a bottom end of the cylinder is pivotally affixed to the clamping bracket 46 while a top end of the piston rod is pivotally affixed to the swivel bracket 44.

The tilt and trim adjustment device 68 also comprises a tilt actuator that is coupled with a housing of the hydraulic mechanism to actuate the hydraulic pump. The tilt actuator preferably is an electric motor that rotates in a right direction and a reversed direction. When the tilt actuator is activated, the hydraulic pump operates and the piston rod expands from the cylinder or contracts into the cylinder. With the expanding movement of the piston rod, the swivel bracket 44 with the drive unit 32 is tilted up or trimmed up. With the contracting movement of the piston rod, the swivel bracket 44 with the drive unit 32 is tilted down or trimmed down.

Preferably, the drive unit 32 moves between a fully tilted down position that is the most lowered position of the drive unit 32 and a fully tilted up position that is the most raised position of the drive unit 32 when the tilt actuator is activated. Preferably, a lower tilt range is a trim adjustment range and a tilt range extending higher than the trim adjustment range is a tilt range in a narrow sense. As used through the description, the term "tilt" means a movement of the drive unit 32 in the tilt range in the narrow sense unless indicated otherwise or otherwise readily apparent from the context use.

Normally, the propulsion device 43 is submerged while the drive unit 32 moves during the trim adjustment range. A position of the watercraft 42 varies in accordance with a trim adjustment position when the propulsion device 43 is powered. A higher trim adjustment position is suitable for a high speed running of the watercraft 42 because a bow portion of the watercraft 42 can be slightly lifted up by the thrust force of the propulsion device 43 and the watercraft 42 can easily transfer to a planing state. On the other hand, a lower trim adjustment position is suitable for a low speed running that includes a troll running and also for accelerating the running speed. The propulsion device 43 can be out of the water body while the drive unit 32 moves during the tilt range. Thus, the drive unit 32 is placed in a tilt position when the operator or user wants to keep the drive unit 32 out of the water body.

The power head 38 comprises a prime mover. The prime mover in this embodiment is an internal combustion engine 72. Other prime movers such as, for example, an electric motor can replace the engine 72. The power head 38 further comprises a protective cowling assembly 74. Preferably, the protective cowling assembly 74 defines a generally closed cavity and the engine 72 is disposed within the protective cowling assembly 74. The protective cowling assembly 74 preferably comprises a top cowling member and a bottom cowling member. The top cowling member preferably is detachably affixed to the bottom cowling member by a coupling mechanism so that a user, operator, mechanic or repair person can access the engine 72 for maintenance or for other purposes.

The top cowling member preferably has an air intake opening through which ambient air is drawn into the cavity of the protective cowling assembly 74. The intake opening preferably is formed at a rear and upper portion of the top cowling member. Typically, the top cowling member tapers in girth toward its top surface, which is in the general proximity of the air intake opening.

The bottom cowling member preferably has an opening at its lowermost portion through which an uppermost portion of the housing unit 36 extends. The bottom cowling member and the uppermost portion of the housing unit 36 together form a tray. The engine 72 is placed onto this tray and is affixed to the housing unit 36. The engine 72 thus is positioned generally atop the drive unit 32.

The engine 72 preferably is a four-cylinder, four-cycle engine and comprises an engine body 78. The engine body 78 comprises a cylinder block that defines cylinder bores extending horizontally and spaced apart vertically with each other. Pistons reciprocally disposed in the cylinder bores. A cylinder head is affixed to one end of the cylinder block. The cylinder bores, the pistons and the cylinder head together define combustion chambers.

A crankcase member is affixed to another end of the cylinder block to define a crankcase chamber therebetween. A crankshaft 80 preferably is journaled between the cylinder block and the crankcase member. The crankshaft 80 is coupled with the pistons through connecting rods and rotates with the reciprocal movement of the pistons.

The engine 72 preferably has one or more camshafts extending generally vertically and journaled on the cylinder head. The camshafts preferably actuate intake and exhaust valves. The crankshaft 80 preferably has a drive pulley or sprocket while the camshafts have driven pulleys or sprockets. An endless transmitter such as, for example, a timing belt or timing chain is wound around the pulleys or sprockets. Thus, the crankshaft 80 drives the camshafts through the transmitter.

An air intake device preferably is disposed on the engine body 78 on the port side to draw the air in the cavity and delivers the air to the combustion chambers. The intake valves are part of the intake device and allow the air to go into the combustion chambers when the intake valves do not close intake ports of the combustion chambers. The intake device preferably has a regulating device that regulates output of the engine 72. In the illustrated embodiment, the regulating device is a throttle valve unit 82 that comprises four throttle valves 84. Each throttle valve 84 preferably is a butterfly type valve and is disposed within each intake passage 86 of the intake device. The throttle valve unit 82 regulates an amount of the air or airflow to the combustion chambers in accordance with an angular position or open degree thereof. A throttle valve link 90 connects the respective throttle valves 84 together with each other such that all the throttle valves 84 simultaneously move. A throttle valve actuator 92 preferably is coupled with a bottom end of the throttle valve link 90 through a drive mechanism 94 such as, for example, a geared mechanism to actuate the throttle valve unit 82. In the illustrated embodiment, the throttle valve actuator 92 preferably is an electric motor that rotates in a right direction and a reversed direction. When activated, the throttle valve actuator 92 actuates the throttle valve link 90 and the throttle valve link 90 moves the throttle valves 90 between a substantially fully closed position and a fully open position. That is, the throttle valve actuator 92 changes a magnitude of regulation as to the air amount made by the throttle valves 90. Unless the environmental circumstances change, an engine speed of the engine 72 increases generally along the increase of the air amount or airflow rate. In other words, the output of the engine 72 increases while the air amount or airflow rate increases.

A charge former such as, for example, a fuel injection system preferably supplies fuel to the combustion chambers to make air/fuel charges in the combustion chambers. A control device such as, for example, an electronic control unit (ECU) 96 preferably controls an amount of the fuel such that an air/fuel ratio can be kept in the optimum state. The illustrated ECU 96 is affixed to a front surface of the engine body 78. The ECU 96 preferably comprises a microprocessor which is a central processor unit (CPU), one or more storage or memory units, input and output units and an interface unit that connects those foregoing units. Control maps preferably are stored in the storage. The control maps can be used in the fuel amount control and other controls. Other charge formers such as, for example, carburetors can replace the fuel injection system.

A firing device having spark plugs exposed into the combustion chambers preferably ignites the air/fuel charges in the combustion chambers also under control of the ECU 96. Abrupt expansion of the volume of the air/fuel charges, which burn in the combustion chambers, moves the pistons to rotate the crankshaft 80.

An exhaust device routes exhaust gases in the combustion chambers to an external location of the outboard motor 30. The exhaust valves are part of the exhaust device and allow the exhaust gases to go out from the combustion chambers when not closed. Majority of the exhaust gases preferably is discharged to the body of water through exhaust sections defined within the housing unit 36.

A driveshaft 98 is coupled with the crankshaft 80 and extends generally vertically through the housing unit 36. The housing unit 36 journals the driveshaft 98 for rotation and the crankshaft 80 drives the driveshaft 98. The housing unit 36 also journals a propulsion shaft 100 for rotation. The propulsion shaft 100 extends generally horizontally through a lower portion of the housing unit 36. The driveshaft 98 and the propulsion shaft 100 are preferably oriented normal to each other (e.g., the rotation axis of the propulsion shaft 100 is at 90° to the rotation axis of the driveshaft 98). Because the driveshaft 98 is coupled with the crankshaft 80 to convey the output of the engine 72 to the propulsion shaft 100, the crankshaft 80 and the driveshaft 98 together from an output shaft of the engine 72 in this embodiment.

The propulsion shaft 100 drives the propulsion device 43 through a transmission 102. In the illustrated arrangement, the propulsion device 43 is a propeller 104 that is affixed to an outer end of the propulsion shaft 100. The propulsion device 43, however, can take the form of a dual, a counter-rotating system, a hydrodynamic jet, or any of a number of other suitable propulsion devices. A shift mechanism 106 associated with the transmission 102 changes positions of the transmission 102. The propeller 104 preferably changes among forward, reverse and neutral modes in accordance with the positions of the transmission 102. In the forward mode, the propeller 104 rotates in a right rotational direction that propels the watercraft 42 forwardly. In the reverse mode, the propeller 104 rotates in a reverse rotational direction that propels the watercraft 42 backwardly. In the neutral mode, the propeller 104 does not rotate and does not propel the watercraft 42 either forwardly or backwardly.

The transmission 102 preferably comprises a drive pinion 110, a forward bevel gear 112 and a reverse bevel gear 114 to couple the two shafts 98, 100. The drive pinion 110 is disposed at the bottom end of the driveshaft 98. The forward and reverse bevel gears 112, 114 are disposed on the propulsion shaft 100 and spaced apart from each other. Both bevel gears 112, 114 always mesh the drive pinion 110. The bevel gears 112, 114, however, race on the propulsion shaft 100 unless fixedly coupled with the propulsion shaft 100.

A dog clutch unit 116 is slideably but not rotatably disposed between the forward and reverse bevel gears 112, 114 on the propulsion shaft 100 such that clutch member 118 selectively engages the forward bevel gear 112 or the reverse bevel gear 114 or does not engage any one of the forward and reverse bevel gears 112, 114. The forward bevel gear 112 or the reverse bevel gear 114 can be fixedly coupled with the propulsion shaft 100 when the clutch member 118 engages the forward bevel gear 112 or the reverse bevel gear 114, respectively.

The shift mechanism 106 preferably includes a shift rod 120 that extends vertically through the steering shaft 46 and the lower portion of the housing unit 36. A top end of the shift rod 120 extends upward beyond the bottom cowling member. The shift rod 120 can pivot about an axis thereof. The shift rod 120 preferably has a shift cam at the bottom. The shift cam abuts a cam follower defined in a recessed front end of the dog clutch unit 116. The dog clutch unit 116 thus follows the pivotal movement of the cam and the clutch member 118 slides on the propulsion shaft 100 to engage either the forward or reverse bevel gear 112, 114 or not engage any one of the bevel gears 112, 114. The transmission 102 is placed in a forward shift position corresponding to the forward mode of the propeller 104 when the clutch member 118 engages the forward bevel gear 112. The transmission 102 is placed in a reverse shift position corresponding to the reverse mode of the propeller 104 when the clutch member 118 engages the reverse bevel gear 112. The transmission 102 is placed in a neutral position corresponding to the neutral mode of the propeller 104 when the clutch member 118 does not engage the forward bevel gear 112 nor the reverse bevel gear 114. Preferably, the neutral position is located between the forward and reverse positions.

A shift actuator 122 preferably is coupled with a top end of the shift rod 120 through a drive mechanism 124 such as, for example, a geared mechanism. In the illustrated embodiment, the shift actuator 122 preferably is an electric motor that rotates in a right direction and a reversed direction. When being activated, the shift actuator 122 rotates the shift rod 120. The transmission 102 thus can move between the forward shift position and the reverse shift position.

With reference to FIGS. 1–4, a control system 130 for the outboard motor 30 is described below.

Figure 3:
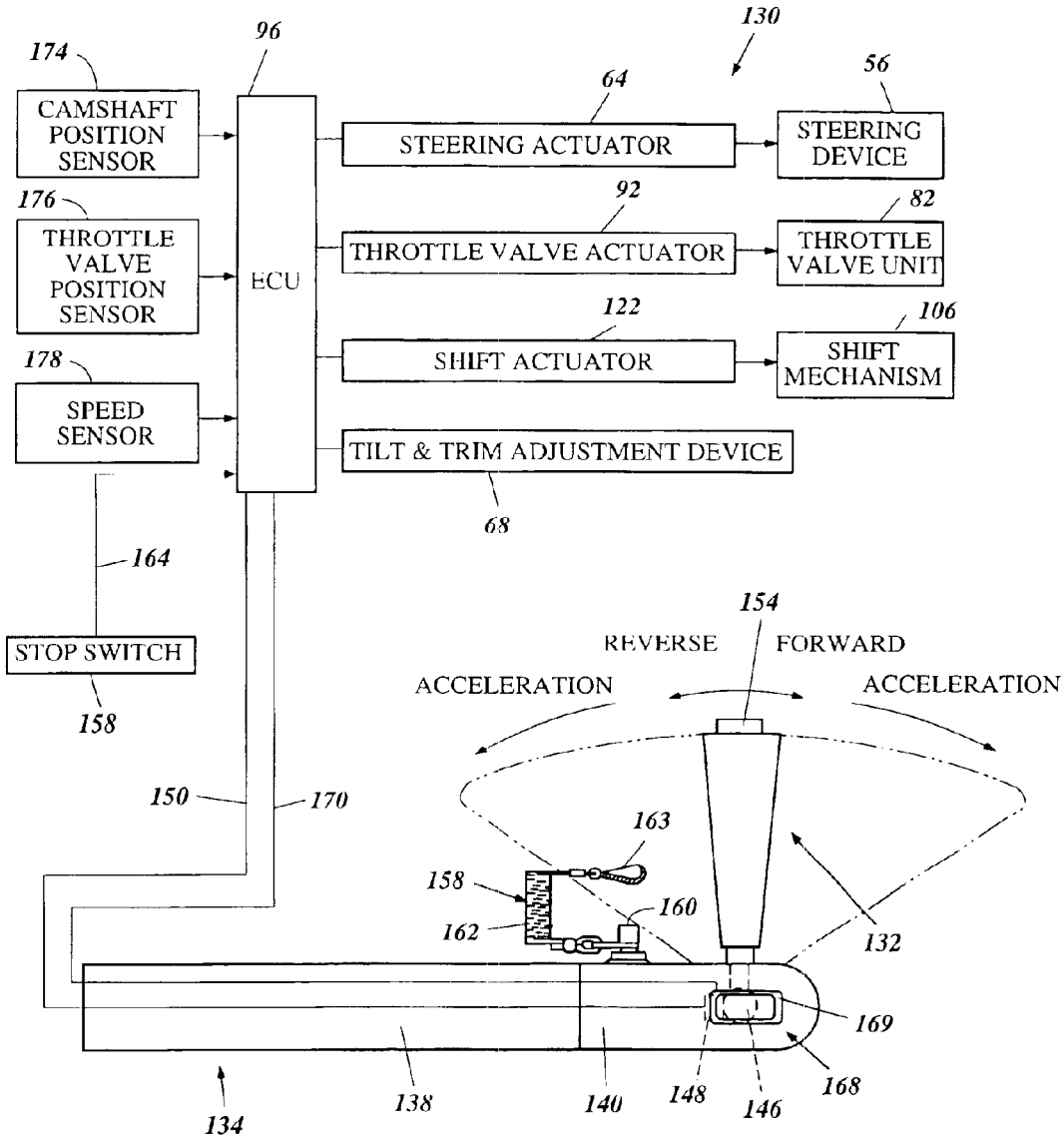
FIG. 3 illustrates a control system that includes a stick and a stop switch arranged on a support unit, an enlarged side view of the stick, the stop switch and the support unit on the starboard side shown in this figure.

As best shown in FIG. 3, the control system 130 preferably comprises a control device that controls the steering actuator 64, the throttle valve actuator 92, the shift actuator 122 and the actuator of the tilt and trim adjustment device 68. As described above, the steering actuator 64 actuates the steering device 56, the throttle valve actuator 92 actuates the throttle valve unit 82, the shift actuator 122 actuates the shift mechanism 106, and the actuator of the tilt and trim adjustment device 68 actuates the tilt and trim adjustment device 68. The control device in the illustrated embodiment is the ECU 96. Other control devices can be used. Also, the actuators 64, 92, 122 and the actuator of the tilt and trim adjustment device 68 can be separated into more than two groups and multiple control devices can control the respective groups of the actuators. The actuators 64, 92, 122, the actuator of the tilt and trim adjustment device 68, the steering device 56, the throttle valve unit 82, the shift mechanism 106 and the tilt and trim adjustment device 68 form a part of the control system 130 in this embodiment.

The control system 130 also comprises an operating device that provides the ECU 96 with control commands to control the actuators 64, 92, 122. The operating device can change its physical positions to selectively generate the control commands. The operating device in the illustrated embodiment is a stick 132.

A support unit 134 preferably extends generally upward and forward from the bracket assembly 34 to support the stick 132. The support unit 134 preferably comprises a fixed member 136, a movable member 138 and a detachable member 140.

The fixed member 136 is affixed to a portion of a front surface of the clamping bracket 46 by appropriate fasteners such as, for example, bolts and nuts. As best shown in FIG. 2, the portion of the clamping bracket 46 where the fixed member 136 is affixed is preferably slightly spaced apart from the center plane CP such that the fixed member 136 is positioned on the port side. The fixed member 136 preferably extends straight upward and forward from the portion of the clamping bracket 46.

The movable member 138 preferably is affixed to a top end of the fixed member 136 for pivotal movement about a pivot axis of a pivot shaft 144 that extends generally horizontally. The illustrated movable member 138 extends horizontally and forwardly. Preferably, a limit member is attached to the pivot shaft 144 to prevent the movable member 138 from moving downward further from the horizontal position of FIG. 1. Because the movable member 138 is allowed to move upward, the movable member 138 together with the detachable member 140 is collapsible toward the protective cowling 74 when the stick 132 is not in use.

The detachable member 140 preferably is detachably affixed to the movable member 138. Preferably, the stick 132 is swingably affixed to a top surface of the detachable member 140 so as to swing right and left and back and forth about a fulcrum 146 of the stick 132 that is coupled with the detachable member 140. Because the detachable member 140 together with the stick 132 is detachable from the movable member 138, the operator can remotely operate the stick 132.

A stick position sensor 148 preferably is provided close to the fulcrum 146 to detect the physical position of the stick 132. A wire or signal line 150 connects the stick position sensor 148 to the ECU 96. The members 136, 138, 140 of the support unit 134 preferably are tubular members or reversed U-shape members. An opening preferably is disposed at a portion of the clamping bracket 46 where the fixed member 136 is affixed. The bottom cowling member also has an opening in a front surface thereof. The wire 150 thus extends through the tubular or reversed U-shaped members 136, 138, 140 and passes through the opening of the clamping bracket 46 and the opening of the bottom cowling member and extends further to the ECU 96. Because the detachable member 140 is detachable, the wire 150 should be long enough to assure the remote control by the operator.

The stick 132 preferably has a lock mechanism that can keep the stick 132 in a neutral position. The lock mechanism preferably provides a mechanical lock to the stick 132. For example, a frictional lock is applicable. The stick 132 preferably extends right upward when the stick 132 is in its neutral position. A push button 154 is attached atop of the stick 132 to selectively lock and release the stick 132. Preferably, the engine 72 can be started only when the stick 132 is locked at the neutral position so as to prevent the propeller 104 from unintentionally start rotating. For example, the ECU 96 allows the firing device to ignite the air/fuel charges only when the stick 132 is locked at the neutral position before the engine 72 is completely started.

Figure 4:
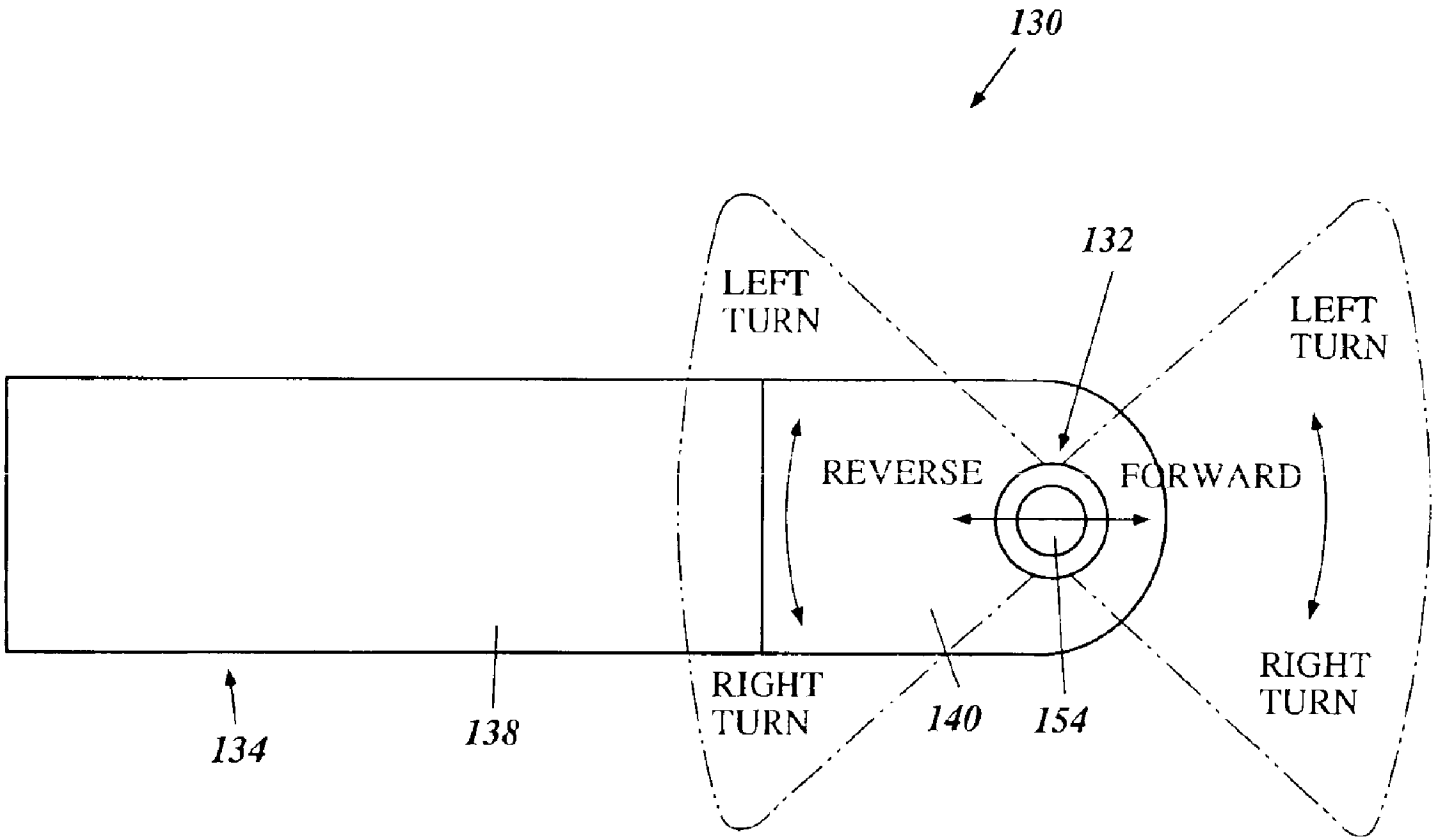
FIG. 4 illustrates an enlarged top plan view of the stick and the support unit without the stop switch.

With reference to FIGS. 3 and 4, the neutral position of the stick 132 provides the ECU 96 with a control command that commands the ECU 96 to control the actuators 64, 92, 122 to their initial positions. That is, the steering actuator 64, at its initial position, actuates the steering device 56 to set the drive unit 32 to a non-steered position. Also, the throttle valve actuator 92, at its initial position, actuates the throttle valve unit 82 to set the respective throttle valves 84 to a substantially closed position at which the engine 72 idles. The shift actuator 122, at its initial position, actuates the shift mechanism 106 to set the transmission 102 to the neutral shift position (i.e., the neutral mode of the propeller 104). Under the idle operation of the engine 72, if the transmission 102 is in either the forward or reverse shift position, the outboard motor 30 propels the associated watercraft 30 forward or backward, respectively. This is a trolling mode of the outboard motor 30. Preferably, the back and forth swing in a minimum range around the neutral position of the stick 132 still gives the ECU 96 the neutral shift position command of the shift mechanism 106 and the substantially closed position command of the throttle valve unit 82.

With continued reference to FIGS. 3 and 4, the back and forth swing movements of the stick 132 over the minimum range provide the ECU 96 with control commands that correspond to the forward and reverse shift positions of the transmission 102 (i.e., the forward and reverse propulsion modes of the propeller 104). More specifically, a forward swing of the stick 132 beyond one limit end of the minimum range gives the ECU 96 the control command that commands the ECU 96 to control the shift actuator 122 to actuate the shift mechanism 106 for the forward shift position. Also, a backward swing of the stick 132 beyond another limit end of the minimum range gives the ECU 96 the control command that commands the ECU 96 to control the shift actuator 122 to actuate the shift mechanism 106 for the reverse shift position.

The back and forth swing movements in both directions from positions beyond the limit ends of the minimum range to fully swung positions provide the ECU 96 with the control command that commands the ECU 96 to control the throttle valve actuator 92 to position the throttle valves 84 between the substantially closed position and the fully open position. In other words, a swing amount of the stick 132 out of the minimum range gives a throttle valve control position that accelerates the engine operation. Thus, ranges extending on both sides of the minimum range to the fully swung positions are acceleration ranges. The closer the stick 132 approaches the fully swung positions within the acceleration ranges, the higher the engine speed of the engine 72.

With reference to FIG. 4, the left and right swing movements of the stick 132 provide the ECU 96 with the control commands that command the ECU 96 to control the steering actuator 64 such that the steering device 56 turns the drive unit 32 right and left. In the illustrated embodiment, when the stick 132 swings left in the view of FIG. 4, the ECU 96 controls the steering actuator 64 such that the watercraft 42 turns right. When the stick 132 swings right in the view of FIG. 4, the ECU 96 controls the steering actuator 64 such that the watercraft 42 turns left.

As thus constructed in the illustrated embodiment, the physical position change of the single stick can provide control commands of the steering actuator, the throttle valve actuator and the shift actuator to the ECU. In addition, the control commands are electric signals that can be easily amplified or non-linearly changed. The control system thus can provide the operator with a good operability that fits the operator's desire.

With reference to FIGS. 1–3, a stop switch assembly 158 also is disposed on the top surface of the detachable member 140 of the support unit 134. The stop switch assembly 158 can be used to stop the engine operation in certain emergency situations. The stop switch assembly 158 comprises an electrical switch unit, a switching member 160 and a lanyard 162. The major part of the switch unit is disposed under the switching member 160. The switch unit works to stop the engine operation when the switching member 160 is out of a retained position. One end of the lanyard 162 is inserted below the switching member 160 to keep the switching member 160 in the retained position. Normally, the lanyard 162 is wound up (i.e., retracted). The other end of the lanyard 162 has a ringed portion or hook 163 that is attached to the operator's wrist, wear or something like that.

A wire or signal line 164 connects the switch unit of the stop switch 158 to the ECU 96. Like the foregoing wire 150, the wire 164 preferably extends through the tubular or reversed U-shaped members 136, 138, 140 and passes through the opening of the clamping bracket 46 and the opening of the bottom cowling member and extends further to the ECU 96. The wire 164 should be long enough to assure the remote control by the operator.

In the event such that the operator falls down to the body of water, the lanyard 162 is extending and the inserted end of the lanyard 162 comes off from the switching member 160 when the lanyard 162 has fully extended. The switching member 160 thus is out of the retained position and the switch unit sends a stop signal to the ECU 96. The ECU 96 thus stops the engine operation based upon the stop signal. For example, the ECU 96 disables the firing device from igniting the air/fuel charges or disables the fuel injection system from injecting fuel. The operator can simply push the switching member 160 to activate the switch unit even though the lanyard 162 keeps the switching member 160 in the retained position.

The tilt and trim adjustment device 68 in the illustrated embodiment can be controlled manually or automatically through the ECU 96 to move the drive unit 32 in the trim range. As used through this description, the term "manual trim control" means that the trim movement is controlled manually, and the term "automatic trim control" means that the trim movement is controlled automatically.

With reference to FIG. 3, a power tilt and trim switch assembly 168 preferably is affixed to a side surface of the detachable member 140 of the support unit 134 on the port side. The trim switch assembly 168 preferably provides a switch function and an operating function. The switch function is to change a trim control mode between a manual trim control mode and an automatic trim control mode and vice versa. The operating function is to provide the ECU 96 with a control command regarding either a trim up movement or a trim down movement and another control command regarding an angular degree amount of the trim movement.

The trim switch assembly 168 preferably comprises an electrical switch unit and a switching member 169 that changes its physical positions to bring the switch unit into the switch function and the operating function. A wire or signal line 170 connects the switch unit to the ECU 96. Like the foregoing wires 150, 164, the wire 170 preferably extends through the tubular or reversed U-shaped members 136, 138, 140 and passes through the opening of the clamping bracket 46 and the opening of the bottom cowling member and extends further to the ECU 96. The wire 170 should be long enough to assure the remote control by the operator.

The switching member 169 moves reciprocally along a horizontal axis that extends laterally relative to the detachable member 40 when the operator pushes a center of the switching member 169 to realize the switch function. The switching member 169 preferably has two stable positions at both ends of the reciprocal movement. The stable positions alternately and electrically set the switch unit to a manual trim control state and an automatic trim control state whenever the operator pushes the switching member 169. Initially, the switch unit is in the manual trim control state.

The switching member 169 also swings about a vertical axis that extends through a center of the switching member 169 when the operator pushes either end of the switching member 169 to realize the operating function. The swing movement of the switching member 169 is a rocking movement. When the operator pushes one of the switch ends, a trim up command is provided to the ECU 96. When the operator pushes the other switch end, a trim down command is provided to the ECU 96. Also, an amount of the rocking movement of the switching member 169 provides the ECU 96 with the angular amount of the trim up or trim down movement of the drive unit 32. Preferably, the rocking movement of the switching member 169 coercively makes the trim switch assembly 168 to the manual trim control command to the ECU 96.

As thus discussed, the illustrated switching member 169 can move reciprocally and swing to take both the switch function and the operating function. Alternatively, two switching members can replace the single switching member 169. The switching members can be affixed onto the side surface of the detachable member 140 next to each other. One of the switching members can take two positions. The manual trim control state is set when this switching member takes a first position, and the automatic trim control state is set when the switching member takes a second position. On the other hand, the other switching member can be a rocker switch and can be swingably placed on the detachable member 140 to take the rocking movement that provides the trim up or trim down commands. Other types of conventional switches or operating devices can be used instead of the trim switch assembly 168.

With reference to FIGS. 1 and 3, in order to realize the automatic trim control, the control system 130 preferably comprises sensors that sense engine conditions and environmental conditions around the outboard motor 30.

Associated with at least one of the camshafts, a camshaft position sensor 174 is provided to sense a camshaft angle position and to output a camshaft angle position signal to the ECU 96. The ECU 96 can calculate an engine speed using the camshaft angle position signal versus time. In this regard, the camshaft angle position sensor 174 and part of the ECU 96 form an engine speed sensor. In one variation, a crankshaft angle position sensor can replace the camshaft position sensor 174.

Operator's demand or engine load, as indicated by an angular position of the throttle valves 84, is sensed by a throttle valve position sensor 176 which outputs a throttle valve position or load signal to the ECU 96. Alternatively or additionally, an intake pressure sensor can be provided downstream of the throttle valve 84 in one of the intake passages 86 to sense the intake pressure that can also represent the engine load. Further, an air amount sensor such as, for example, an air flow meter can alternatively or additionally be provided to sense an amount of the air in the intake passage 86 that can also represent the engine load.

A speed sensor 178 preferably is disposed at a front end portion of the housing unit 36 which is normally submerged when the outboard motor 30 is not tilted. The speed sensor 178 preferably incorporates a Pitot tube and senses a water pressure in the tube to detect a speed of the outboard motor 30 relative to the body of water. The speed of the outboard motor 30 represents a velocity of the associated watercraft 42. Alternatively, the speed sensor 178 can comprise an impeller type (or paddle wheel type) sensor to sense a rotational speed of the impeller (or paddle wheel) that is rotated by the water that flows along the surface of the housing unit 36. The rotational speed of the impeller (or paddle wheel) generally is proportional to the speed of the outboard motor 30 and the velocity of the watercraft 42.

Other sensors can be equipped. For example, a trim position sensor is provided to sense that the drive unit 32 is positioned within the trim range.

With reference to FIG. 3, assuming that the operator has started the engine 72 when the stick 132 is in the neutral position, the ECU 96 initially sets the manual trim control mode when the engine 72 is started wherever the trim switch assembly 168 is positioned. The flip-flop movement of the switching member 169 of the trim switch assembly 168 thus is effective to manually set a trim position. Additionally, the storage of the ECU 96 stores a control map that can be used to determine a trim position based upon an engine speed, a throttle valve position and a watercraft velocity.

If, for example, the operator wants to manually trim up the drive unit 32 to a higher position, the operator pushes the side of the switching member 169 that corresponds to the trim up movement by a certain degree. A trim up command and an amount of the trim movement are sent to the ECU 96. The ECU 96 controls the actuator (i.e., electric motor) of the tilt and trim adjustment device 68. The tilt and trim adjustment device 68 thus raises the drive unit 32 to the higher position. Also, if the operator wants to manually trim down the drive unit 32 to a lower position, the operator pushes the other side of the switching member 169 that corresponds to the trim down movement by a certain degree. A trim down command and an amount of the trim movement are sent to the ECU 96. The ECU 96 controls the actuator of the tilt and trim adjustment device 68. The tilt and trim adjustment device 68 thus lowers the drive unit 32 to the lower position.

The operator pushes the center portion of the switching member 169 if the operator desires the automatic trim control. The trim switch assembly 168 sends the automatic trim control command to the ECU 96. The ECU 96 thus starts the automatic trim control based upon outputs from the camshaft position sensor 174, the throttle valve position sensor 176 and the speed sensor 178. As noted above, the camshaft position sensor 174 together with a part of the ECU 96 generates an engine speed, and the speed of the outboard motor 30 sensed by the speed sensor 178 represents a velocity of the associated watercraft 42. Preferably, the automatic trim control is inhibited if the trim position sensor does not send an output signal that indicates that the drive unit 32 is positioned within the trim range.

Assuming that the operator initially operates the stick 132 to the forward shift position of the transmission 102 but does not further operate the stick 132 within the acceleration range, the throttle valves 84 are placed at the substantially closed position and the engine 72 is idling. The throttle valve position sensor 176 sends a signal that indicates that the throttle valves 84 are placed at the substantially closed position. Under the condition, the ECU 96 controls the tilt and trim adjustment device 68 to lower the drive unit 32 to the fully trimmed down position because the propeller 104 can most easily grasp the water in this position.

When the operator operates the stick 132 into the acceleration range and thus the engine operation is accelerated from the idling state, the ECU 96 determines a trim position based upon the engine speed and the watercraft velocity. If the engine speed becomes high (i.e., the camshaft rotates fast) but the watercraft velocity is low (i.e., the speed of the outboard motor 30 is slow), the ECU 96 continuously controls the tilt and trim adjustment device 68 to keep the drive unit 32 at the fully trimmed down position. This is because the engine 72 is relatively sudden accelerated and the propeller 104 still needs to grasp the water. In one variation, such sudden acceleration can be determined using a change rate of the output of the throttle valve position sensor 176.

When the watercraft 42 reaches a desired velocity, the operator stops operating the stick 132 and keeps the stick 132 at the position where the stick 132 has been moved within the acceleration range to maintain the engine speed. Under that condition, the ECU 96 determines that the engine speed reaches a constant speed and also the watercraft velocity reaches a constant velocity. The ECU 96 further determines a suitable trim position based upon the watercraft velocity and controls the tilt and trim adjustment device 68 to raise the drive unit 32 to the suitable trim position.

If the engine operation is accelerated when the watercraft 42 proceeds in a constant velocity (i.e., the drive unit 32 is not in the fully trimmed down position), the ECU 96 determines a most appropriate trim position based upon the watercraft velocity and controls the tilt and trim adjustment device 68 to further raise the drive unit 32 to the appropriate trim position.

If the engine operation is decelerated when the watercraft 42 proceeds in a constant velocity, the ECU 96 determines a most appropriate trim position based upon the watercraft velocity and controls the tilt and trim adjustment device 68 to lower the drive unit 32 to the appropriate trim position.

When the operator operates the stick 132 back to the most decelerated position in the acceleration range, the throttle valves 84 return to the substantially closed position. The throttle valve position sensor 176 sends a signal indicative of this throttle valve position to the ECU 96. The ECU 96 determines a trim down amount larger than a normal trim down amount under the condition and controls the tilt and trim adjustment device 68 to lower the drive unit 32 with the determined trim down amount for a next sudden acceleration.

If the operator wants to change to the manual trim control mode from the automatic trim control mode, the operator simply pushes the center portion of the switching member 169 or either side of the switch portion corresponding to the trim up control or the trim down control whichever the operator desires.

The automatic trim control is released when the operator stops the engine operation. The manual trim control is initially set when the engine 72 is started again.

Because the operator can select the automatic trim control mode or the manual trim control mode at his or her choice, the operator can enjoy a tireless cruise if he or she selects the automatic trim control mode, and can enjoy more minute control than the automatic trim control mode if he or she selects the manual trim control mode.

Although the manual trim control is described above, the power tilt and trim switch assembly 168 can be used to manually control the tilt and trim adjustment device 68 in the tilt range.

The detachable member of the support unit can wirelessly communicate with the ECU if the detachable section has a wireless transmitter and the ECU has a wireless receiver. In this alternative, the burdensome wires or wire harness is advantageously removed. In addition, because the detachable member without the wire harness is portable, security of the outboard motor and/or the associated watercraft is enhanced.

The support unit can comprise more than one support member. For example, a single support member, two support members and four support members are applicable. Also, the support unit can be affixed to any portion of the outboard motor. For example, the support unit can extend from the protective cowling.

Although this invention has been disclosed in the context of a certain preferred embodiment, it will be understood by those skilled in the art that the present invention extends beyond the specifically disclosed embodiment to other alternative embodiments and/or uses of the invention and obvious modifications and equivalents thereof. It is also contemplated that various combinations or sub-combinations of the specific features and aspects of the embodiments may be made and still fall within the scope of the invention. It should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. An outboard motor comprising a drive unit and a bracket assembly arranged to support the drive unit for pivotal movement about a steering axis, the drive unit moving between first and second steering positions, the drive unit comprising a prime mover, a propulsion device powered by output of the prime mover, a regulating device arranged to move between first and second regulating positions so as to regulate the output of the prime mover, a transmission arranged to move between first and second shift positions so as to set the propulsion device to one of at least first or second mode, a first actuator arranged to move the drive unit between the first and second steering positions, a second actuator arranged to move the regulating device between the first and second regulating positions, a third actuator arranged to move the transmission between the first and second shift positions, an operating device configured to generate a first control command corresponding to a specific steering position between the first and second steering positions, a second control command corresponding to a specific regulating position between the first and second regulating positions and a third control command corresponding to either the first or second shift position, the operating device having multiple physical positions, the first, second and third control commands selectively generated in response to the physical positions, and a control device configured to control the first, second and third actuators based upon the first, second and third commands, respectively.

2. The outboard motor as set forth in claim 1, wherein the operating device is disposed on the bracket assembly.

3. The outboard motor as set forth in claim 2, wherein a support member extends from the bracket assembly, the operating device is affixed to the support member.

4. The outboard motor as set forth in claim 3, wherein the support member comprises at least first and second sections, the first section is detachable from the second section, the operating device is affixed to the first section.

5. The outboard motor as set forth in claim 3, wherein the support member is collapsible.

6. The outboard motor as set forth in claim 3, wherein the operating device comprises a stick configured to swing relative to the support member.

7. The outboard motor as set forth in claim 6, wherein the stick swings back and forth and right and left.

8. The outboard motor as set forth in claim 7, wherein a right and left swing of the stick gives the first command, a back and forth swing of the stick gives the third command, and a swing amount of the back and forth swing gives the second command.

9. The outboard motor as set forth in claim 3 additionally comprising a stop device that inhibits the prime mover from further operating, the stop device is disposed on the support member.

10. The outboard motor as set forth in claim 1, wherein the operating device swings right and left and back and forth to change the physical positions.

11. The outboard motor as set forth in claim 10, wherein a right and left swing of the operating device gives the first command, a back and forth swing of the operating device gives the third command, and a swing amount of the back and forth swing gives the second command.

12. The outboard motor as set forth in claim 1, wherein the bracket assembly comprises a clamping bracket and a swivel bracket, the clamping bracket adapted to be mounted on an associated watercraft and support the swivel bracket for pivotal movement about a tilt axis that extends generally horizontally, the swivel bracket supporting the drive unit for the pivotal movement about the steering axis that extends generally vertically.

13. The outboard motor as set forth in claim 12, wherein the bracket assembly additionally comprises a hydraulic device connected to the drive unit, the first actuator operates the hydraulic device.

14. The outboard motor as set forth in claim 1, wherein the prime mover is an internal combustion engine, the regulating device is a throttle valve that regulates an amount of air to a combustion chamber of the engine, the second actuator operates the throttle valve.

15. The outboard motor as set forth in claim 1, wherein the prime mover has an output shaft, the propulsion device has a propulsion shaft, the transmission couples the output shaft with the propulsion shaft.

16. The outboard motor as set forth in claim 15, wherein the transmission comprises a first gear coupled with the output shaft, second and third gears both meshing the first gear and are selectively coupled with the propulsion shaft, and a clutch unit engaging either the second or third gear, the second gear is coupled with the propulsion shaft when the clutch unit engages the second gear, the third gear is coupled with the propulsion shaft when the clutch unit engages the third gear, the propulsion device is set to the first mode when the second gear is coupled with the propulsion shaft, the propulsion device is set to the second mode when the third gear is coupled with the propulsion shaft, the third actuator operates the clutch unit.

17. The outboard motor as set forth in claim 1, wherein the bracket assembly further supports the drive unit for pivotal movement about a tilt axis that extends generally horizontally, additionally comprising a fourth actuator arranged to tilt the drive unit between first and second trim positions, a second operating device configured to generate a fourth control command corresponding to a specific trim position between the first and second trim positions, the second operating device having multiple physical positions, the control device further controls the fourth actuator based upon the fourth control command.

18. The outboard motor as set forth in claim 17, wherein the second operating device is disposed on the bracket assembly.

19. The outboard motor as set forth in claim 17 additionally comprising a first sensor configured to sense an actual regulating position of the regulating device, a second sensor configured to sense an actual output of the prime mover, and a third sensor configured to sense an actual proceeding speed of the outboard motor, the control device automatically controlling the fourth actuator based upon at least one of signals from the first, second and third sensors without the fourth control command.

20. The outboard motor as set forth in claim 19 additionally comprising a switch configured to change a first control mode using the fourth control command to a second mode using at least one of signals from the first, second and third sensors without the fourth control command and vice versa.

21. The outboard motor as set forth in claim 20, wherein the second operating device acts as the switch when the second operating device takes one of the multiple physical positions.

22. The outboard motor as set forth in claim 1, wherein the bracket assembly further supports the drive unit for pivotal movement about a tilt axis that extends generally horizontally, additionally comprising a fourth actuator arranged to tilt the drive unit between first and second trim positions, a first sensor configured to sense an actual regulating position of the regulating device, a second sensor configured to sense an actual output of the prime mover, and a third sensor configured to sense an actual proceeding speed of the outboard motor, the control device controlling the fourth actuator based upon at least one of signals from the first, second and third sensors.

23. An outboard motor comprising a drive unit that has a prime mover and a propulsion device powered by output of the prime mover, a supporting device adapted to support the drive unit on an associated watercraft for steering movement, a regulating device arranged to move between first and second regulating positions so as to regulate the output of the prime mover, a transmission arranged to move between first and second shift positions so as to set the propulsion device to either first or second mode, a first actuator arranged to move the drive unit between the first and second steering positions, a second actuator arranged to move the regulating device between the first and second regulating positions, a third actuator arranged to move the transmission between the first and second shift positions, an operating device configured to generate a first control command corresponding to a specific steering position between the first and second steering positions, a second control command corresponding to a specific regulating position between the first and second regulating positions and a third control command corresponding to either the first or second shift position, the operating device moving right and left and back and forth, a right and left movement of the operating device generating the first command, a back and forth movement of the operating device generating the third command, and an amount of the back and forth movement generating the second command, and a control device configured to control the first, second and third actuators based upon the first, second and third commands, respectively.

24. An outboard motor comprising a drive unit and a bracket assembly arranged to support the drive unit for pivotal movement about a tilt axis that extends generally horizontally, the drive unit comprising a prime mover, a propulsion device powered by output of the prime mover, a regulating device arranged to move between first and second regulating positions so as to regulate the output of the prime mover, an actuator arranged to tilt the drive unit between first and second trim positions, a first sensor configured to sense an actual regulating position of the regulating device, a second sensor configured to sense an actual output of the prime mover, a third sensor configured to sense an actual proceeding speed of the outboard motor, and a control device controlling the actuator based upon at least one of signals from the first, second and third sensors.

25. The outboard motor as set forth in claim 24, wherein the prime mover is an internal combustion engine, the regulating device is a throttle valve that regulates an amount of air to a combustion chamber of the engine, the first sensor senses an actual throttle valve position, the second sensor senses an actual engine speed of the engine.

26. An outboard motor comprising a drive unit that has a prime mover and a propulsion device powered by output of the prime mover, a supporting device adapted to support the drive unit on an associated watercraft for steering movement, means for changing the output of the prime mover, means for changing a propulsion mode of the propulsion device, means for steering the drive unit, means for generating control commands for the prime mover output changing means, the propulsion mode changing means and the steering means in response to physical positions of a single member, and means for controlling the prime mover output changing means, the propulsion mode changing means and the steering means based upon the control commands.

27. A method for controlling an outboard motor that has a steerable drive unit and a single operating member, the drive unit having a prime mover and a propulsion device powered by the prime mover, comprising generating a first control command that provides a steering position of the drive unit at a first position of the operating member, generating a second control command that provides a magnitude of output of the prime mover at a second position of the operating member, generating a third control command that provides a propulsion mode of the propulsion device at a third position of the operating member, steering the drive unit based upon the first control command, controlling the output of the prime mover based upon the second control command, and setting the propulsion mode of the propulsion device based upon the third control command.

28. The method as set forth in claim 27 additionally comprising moving the operating member right and left to generate the first control command.

29. The method as set forth in claim 27 additionally comprising moving the operating member back and forth to generate the second and third control commands.

30. An outboard motor comprising a drive unit that has a prime mover and a propulsion device powered by output of the prime mover, a supporting device adapted to support the drive unit on an associated watercraft for tilt movement, means for regulating the output of the prime mover, means for tilting the drive unit, means for sensing at least a regulating condition of the regulating means, the output of the prime mover, and a proceeding speed of the outboard motor, and means for controlling the tilting means based upon a result of sensing by the sensing means.

31. A method for controlling an outboard motor that has a tiltable drive unit, the drive unit having a prime mover and a propulsion device powered by the prime mover, comprising regulating output of the prime mover, sensing a magnitude of the regulation, sensing the output of the prime mover, sensing a speed of the outboard motor, and tilting the drive unit based upon at least one of the sensed magnitude of the regulation, the sensed output of the prime mover and the sensed speed of the outboard motor.

* * * * *